United States Patent [19]

Lawson et al.

[11] 4,050,926

[45] Sept. 27, 1977

[54] CONTINUOUS SULPHUR DROSSING PROCESS

[75] Inventors: Frank Lawson; Glen Waverley, both of Victoria; Denby Harcourt Ward; Robert George Kelly, both of Port Pirie, all of Australia

[73] Assignees: The Broken Hill Associated Smelters Proprietary Limited; Monash University, both of Melbourne, Australia

[21] Appl. No.: 705,356

[22] Filed: July 14, 1976

[30] Foreign Application Priority Data

Sept. 8, 1975 Australia ..... 3079/75

[51] Int. Cl.[2] ..... C22B 13/06

[52] U.S. Cl. ..... 75/78; 75/93 DA

[58] Field of Search ..... 75/78, 93 DA, 24, 77–79, 75/93 R

[56] References Cited

U.S. PATENT DOCUMENTS

| | | | |
|---|---|---|---|
| 1,386,503 | 8/1921 | Hulst et al. | 75/78 |
| 1,891,978 | 12/1932 | Gross et al. | 75/78 |
| 3,666,441 | 5/1972 | Milner | 75/78 |

*Primary Examiner*—M. J. Andrews
*Attorney, Agent, or Firm*—Finnegan, Henderson, Farabow & Garrett

[57] ABSTRACT

A continuous sulphur drossing process for the decoppering of lead comprising the steps of flowing lead bullion into the first of a series of at least two reaction vessels; continuously agitating the lead bullion in the first reaction vessel, adding sulphur to the lead bullion during the continuing agitation; continuously and concurrently transferring the lead bullion, dross arising from the copper reacted with the sulphur, and ay unreacted sulphur from each reaction vessel to the next in the series without backmixing; agitating the contents of each reaction vessel; maintaining the total residence time of the materials in he reaction vessels below that in which a significatn amount of reversion to elemental copper would occur, thereby substantially preventing re-solution of copper in the bullion; continuously and concurrently transferring decoppered bullion and dross from the final reaction vessel in the series to an unagitated dross separation vessel; removing the dross from the surface of the decoppered bullion in the dross separation vessel; and continuously withdrawing decoppered bullion from the dross separation vessel.

17 Claims, 6 Drawing Figures

CONTINUOUS SULPHUR DROSSING PROCESS

Figures 1, 3:
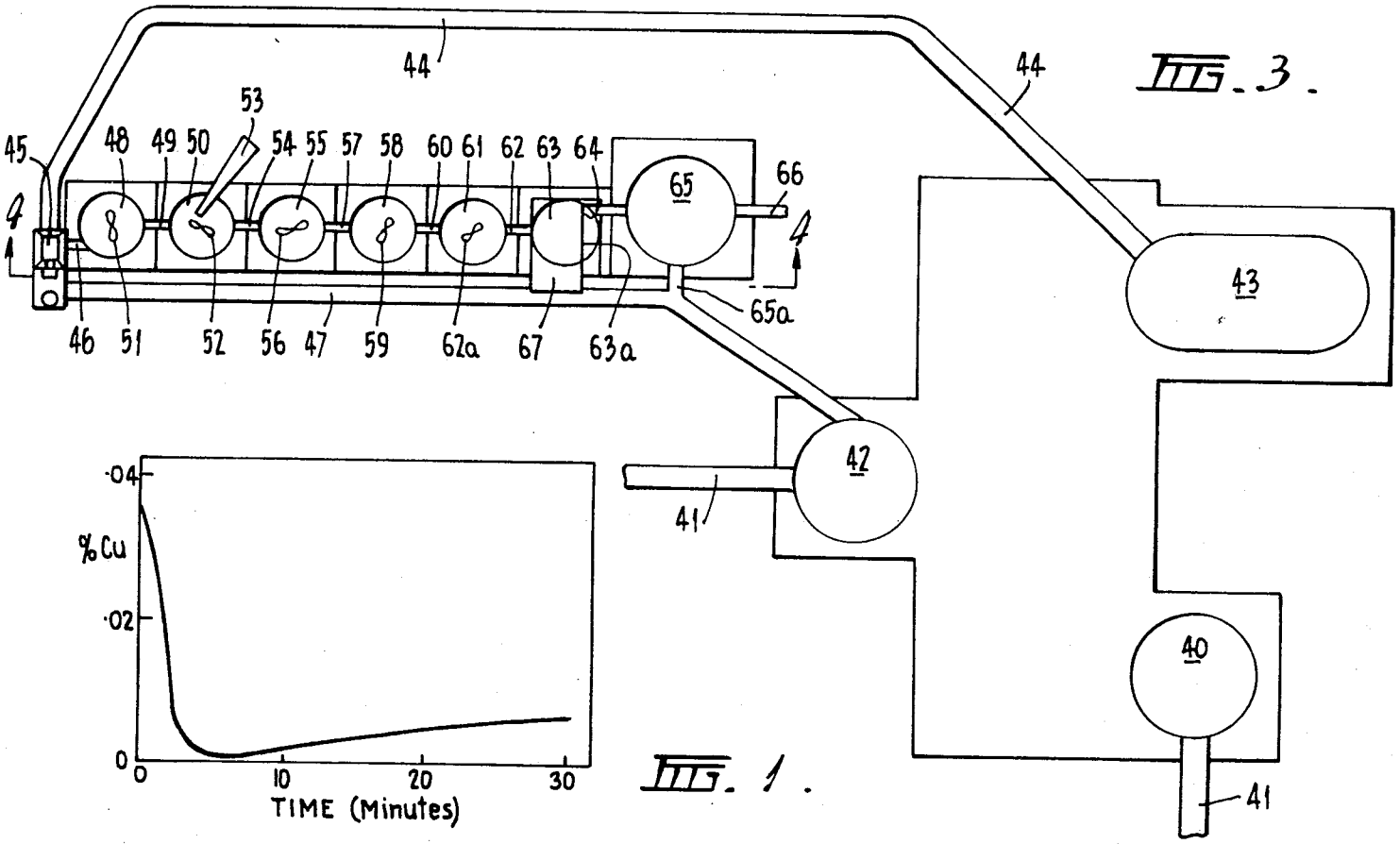

This invention relates to improvements in the sulphur drossing of lead, to reduce the copper content thereof, and refers especially to a continuous process for the decoppering of lead by the sulphur drossing process and to apparatus for carrying out such process.

The removal of copper in two operations from lead bullion produced in blast furnaces usually precedes other refining operations.

The first operation known as "copper drossing" or "hot drossing" comprises a cooling of the bullion from its initial temperature of about 900° C to 1000° C to about 350° C. According to the Pb-Cu-S phase diagram of Davey (1963) Trans. Institute of Mining and Metallurgy, 72 (8):553–620, copper and some of the lead combine with sulphur present in the bullion to form cuprous sulphide, $Cu_2S$, and lead sulphide, PbS. At the end of the operation, the bullion is in contact with a mixture of $Cu_2S$ and PbS at a temperature as low as can be handled practically.

The second operation of decoppering known as "sulphur drossing" has hitherto invariably been practised as a batch process. Sulphur is added to the lead bullion which contains copper in solution and which is heated in a suitable vessel, the temperature being preferably adjusted to close to the freezing point of the bullion. Stirring is continued for a suitable period and is then discontinued, and the copper-containing dross which has formed floats to the surface and is removed manually or mechanically. The decoppered lead is removed from the vessel for further treatment, leaving the vessel empty for a further charge of untreated bullion.

The sulphur drossing process as hitherto practised possesses a number of disadvantages, including the inherent disadvantages necessarily resulting from the batch method of operation, the arduous labour and difficulty and hygiene hazards involved in separating the dross from the decoppered bullion, and the high degree of care required in order to achieve a consistently high degree of removal of copper from the lead in practical operations.

It is an object of this invention to provide a continuous process for the decoppering of lead by sulphur drossing, which enables the disadvantages of the existing batch process to be substantially overcome, while a further object is to provide an improved process for the decoppering of lead which is more efficient and economical than existing sulphur drossing processes and which enables decoppered lead having a very low copper content to be produced commercially.

Laboratory batch experiments and observations of industrial scale batchwise operations which we have carried out have produced a series of graphs of copper concentration versus time. The curves are all of the general shape shown in FIG. 1 of the accompanying drawings.

When sulphur is added to molten lead containing small quantities of copper, with agitation, the dross formed has been found to contain cuprous sulphide ($Cu_2S$), cupric sulphide (CuS), and lead sulphide (PbS), as well as entrained lead, and the reactions which are considered to occur during the process are:

$$Cu + S = CuS \quad (1)$$

$$Pb + S = PbS \quad (2)$$

$$CuS + Cu = Cu_2S \quad (3)$$

$$2\,CuS + Pb = Cu_2S + PbS \quad (4)$$

These reactions are essentially kinetically irreversible. Reactions (1) and (2) occur initially and the rate constant for reaction (1) is much greater than the rate constant for reaction (2), thereby causing an initial rapid decrease in the copper concentration of the lead bullion. As the quantity of free sulphur is reduced, reaction (3) occurs. As the dissolved copper is depleted, lead also competes for the cupric sulphide (CuS) by reaction (4).

When the sulphur potential drops significantly, one or more of a number of possible reactions occur by which copper reverts to the bullion. Reactions such as:

$$Cu_2S + Pb = 2Cu + PbS \quad (5)$$

and $$CuS + Pb = Cu + PbS \quad (6)$$

are thermodynamically possible, but it is considered that reaction (5) is more likely to be the significant reversion reaction.

However, it is considered that a kinetic situation obtains, and the minimum of FIG. 1 occurs when the rate of removal of copper into the dross equals the rate of copper reversion to the melt. Finally, at very low sulphur potentials when essentially all elemental sulphur has been used, the rate of reversion exceeds the rate of removal into the dross. Thus, the copper concentration in the bullion increases towards an "equilibrium" value.

We have discovered surprisingly that an industrially acceptable continuous process for the decoppering of lead by the sulphur drossing method can be achieved by, firstly, adding sulphur, e.g., elemental sulphur to the lead or bullion when the copper concentration is at or near its highest value for the material being treated so as, inter alia, to take maximum advantage of the greater rate of reaction (1) relative to that of reaction (2), and, secondly, ensuring that the liquid lead/dross mixture or each element or part thereof remains in the reactor system for a limited period, preferably not more than 25 minutes.

We have found that the reduction in the copper content of the lead bullion proceeds rapidly for a limited period and that normally after a period of about 5 to 15 minutes, depending on the conditions obtaining, the copper content of the bullion is at a minimum. If the reactions are allowed to proceed by maintaining the copper and dross in contact in the reactor system for longer than the optimum period, metallic copper is re-formed and re-dissolves in the lead until an "equilibrium" value is attained. It is therefore a feature of one form of this invention to carry out the process continuously in such a manner that this re-solution of the copper in the lead does not occur to any appreciable extent or is minimised and so that the copper concentration in the lead is reduced to a minimum practicable value and is maintained at this value as closely as possibly until after the decoppered lead has been separated from the dross.

We have discovered surprisingly that the desired results may be achieved, according to one aspect of the invention, by carrying out a continuous sulphur drossing process in a series of reaction stages, preferably in a series of agitated (preferably stirred) reactors, sulphur being added to one or more of these stages or reactors, e.g., to the first or second, and the lead and dross and any unreacted sulphur being transferred continuously and concurrently from each reactor to the next, in sequence, without back-mixing. At least two reaction stages are used, preferably at least three, and more preferably at least four. The decoppered bullion and dross are then passed to a dross separation stage, which is without agitation, in which the dross is separated from the decoppered bullion.

In this specification and in the appended claims the phrase "without agitation" used in relation to the dross separation stage means that no active mechanical or other form of agitation of the decoppered bullion is effected in the dross separation stage, but does not exclude the minor movement or disturbance of the decoppered bullion in the dross separation stage which may be caused by operations such as (a) the addition of the decoppered bullion and dross from the final reaction stage to the dross separation stage (b) the removal of the dross from the decoppered bullion in the dross separation stage or (c) the withdrawal of the decoppered bullion from the dross separation stage.

The average total residence time of the lead and dross in the series of reactors is limited, and is preferably between 5 and 25 minutes, more preferably between 8 and 15 minutes.

The average total residence time of the bullion, dross and sulphur in all stages of the process is preferably not greater than that required for the copper content of the bullion to reach its minimum value.

The term "average residence time" in this specification and claims refers to the average residence time of the material in a single reaction stage or vessel, and is the average time for one complete volume change of that single vessel. The term "average total residence time" in this specification and claims refers to the average residence time of the material for the whole series of reaction stages or vessels through which the bullion flows, and may be regarded as the time for one complete volume change for the whole reactor system, excluding the dross separation stage or vessel.

We do not wish to be limited in any way to any particular theory to explain the improved and advantageous results obtained by using the method and apparatus of this invention, but the following explanation is advanced without limitation thereto.

The rate of copper removal from lead bullion, due to reaction (1) above, is proportional to the sulphur surface area and the copper concentration of the bullion. Therefore, if the copper concentration is high a high rate of copper removal is obtained. There is however a second competing reaction, i.e., reaction (2) above, in which lead is converted to lead sulphide. The rate of reaction (2) is proportional to the sulphur surface area or the quantity of sulphur present. In order to get rapid removal of copper from lead bullion, therefore, it is preferable to add the sulphur at or near the point where the copper content is highest otherwise excessive consumption of sulphur to form lead sulphide occurs according to reaction (2). In this specification and in the appended claims the term "vessel" includes a stage, zone, compartment, pot, tank or chamber. In each stirred reaction vessel of this invention the rate of mixing is extremely rapid so that there should be substantially no concentration variations in the bullion within each stirred reaction vessel itself. The concentration of copper in the bullion in the reaction vessel is therefore assumed to be equal to the concentration of copper in the bullion overflowing from it. When a series of reaction vessels are used according to this invention there are step changes in copper concentration from vessel to vessel. If, for example, in using the process of this invention with four reaction vessels in series there is fed into the first reaction vessel a bullion containing 0.03% copper together with sulphur, the copper content of the bullion in the reaction vessel and the copper content of the bullion in the overflow, within the limited period of treatment in the reaction vessel, may drop to about 0.009%. The overflow from the first reaction vessel contains, together with cupric sulphide and possibly some cuprous sulphide, lead sulphide and lead, some unreacted sulphur. This material when mixed with the bullion in the second reaction vessel may give a concentration of copper of, say, 0.004%. The rate of copper removal in the first reaction vessel, since it depends on the copper concentration, is significantly higher than that in the second reaction vessel, which in turn is higher than that in the third reaction vessel, which is higher than that in the fourth reaction vessel, and so on. The copper concentration in the third and fourth reaction vessels may be, say 0.003% and 0.002% respectively. Under certain conditions the copper concentration in the final reaction vessel may reach 0.001%. If one attempts to carry out the reaction in a single vessel rather than in a series of vessels and if it is desired to produce a copper concentration in the outflow of about 0.002%, the rate of reaction in that single vessel, if such a process were feasible, would be the rate proportional to a copper content of 0.002%, and most of the sulphur would in fact be used to convert lead to lead sulphide rather than copper to copper sulphide. Consequently, the process will not function effectively in a single vessel.

Apparatus according to this invention may comprise a plurality of reaction vessels arranged in series, means for agitating the material in each reaction vessel, means for continuously feeding bullion to the first reaction vessel, means for continuously feeding sulphur to one of the said reaction vessels, means for continuously and concurrently transferring bullion, dross and any unreacted sulphur from each reaction vessel to the next in sequence, means for transferring the decoppered bullion and dross from the final reaction vessel to a dross separation vessel which is without agitation, and means for separating the dross from the decoppered bullion in the dross separation vessel. The sulphur is preferably fed to the first or second reaction vessel in the series. The apparatus preferably includes an unstirred dross separation vessel, means for continuously flowing the decoppered bullion and dross from the final reaction vessel in the series into the dross separation vessel, means in the dross separation vessel for separating the dross from the decoppered bullion, and means for continuously withdrawing decoppered bullion from the dross separation vessel.

Although the invention is described herein in relation to the use of a series of separate reactors or vessels, it will be understood that the process of this invention may be carried out in two or more compartments, zones or chambers of one or more vessels, and the term "vessel" in the appended claims includes such compartments, zones or chambers.

The lead and dross and unreacted sulphur are transferred from each reactor to the next in the series, preferably by overflowing such materials by gravity over a weir, and conveniently for this purpose each reactor is lower than the one preceding it, but it will be understood that the materials may be pumped or otherwise transferred from each reactor to the next.

In one form of the invention the lead bullion to be decoppered is delivered continuously at a controlled rate into a vessel in which the temperature is regulated to a temperature in the range from just above the freezing point of the lead bullion (e.g., about 310° C) to 350° C, preferably to a temperature in the range 315° C to 325° C, and is then fed at a controlled rate, as by gravity or pumping, into one of the reactors of the series, preferably the first or second reactor of the series, which may comprise a stirred vessel provided with temperature control means and with a weir. The temperature of the bullion is preferably reduced to close to the freezing point of the bullion before it is fed into the said reactor.

Sulphur in elemental form, e.g. "flowers of sulphur" in granular form, is fed into the vortex formed in the molten lead in the said reactor by the stirring device and is mixed with the molten lead. The sulphur drossing reactions (1) and (2) occur in the reactor, the rate constant for reaction (1) being greatly in excess of that of reaction (2), and dross is formed which is prevented from floating to the surface of the molten lead in the reactor by vigorous agitation. The average residence time of the molten lead in the said reactor is between 1 and 6 minutes, preferably between 2 and 4 minutes. The partially decoppered bullion and dross and unreacted sulphur flow continuously over the weir into the next stirred reactor, again being directed into the vortex created by the stirring device. Further decoppering of the lead, and dross formation, occur in the said reactor, and the lead and dross and unreacted sulphur flow to the next reactor in the series, and it is found that the copper content of the lead decreases as it progresses through the series of reactors. Preferably at least three or four reactors in series are employed, but the number of reactors will be determined by experimental and practical considerations.

The decoppered bullion and dross from the final reactor flow into an unstirred dross separation pot or vessel in which the dross rises to the surface leaving the decoppered bullion below. The decoppered bullion is removed from the dross separation pot as by an underflow weir and flows to a holding vessel.

The dross is removed from the surface of the bullion in the dross separation pot by manual or mechanical means, and is preferably scraped or transferred into a launder or channel which is adjacent to the upper end of the dross separation pot. A stream of bullion from any convenient source is arranged to flow in the said launder and serves to convey the dross to a vessel for suitable treatment.

The untreated lead bullion to be decoppered by the process and apparatus of this invention may be taken from any suitable source, but is preferably bullion which has previously been treated in a continuous drossing furnace (hereinafter termed the C.D.F.) of the type described in U.S. Pat. No. 3368805.

In one mode of operation of the invention the incoming stream of untreated bullion, e.g., from the C.D.F., is separated into a stream which is fed at a controlled volumetric rate into the temperature regulating vessel, and an excess stream which may be used to flow into and along the launder adjacent to the dross separation pot in order to convey the dross from said pot to further treatment, e.g., to further treatment in the C.D.F.

The quantity of sulphur added to the lead bullion, or the rate of sulphur feed, is important. If too little sulphur is used, the degree of decoppering is insufficient and the results are not predictable. If too much is used, the dross produced contains excessive quantities of lead sulphide which have to be re-treated. The rate of feed or addition of sulphur to the lead bullion is preferably adjusted to between 0.05% and 0.25% of sulphur to lead by weight, more preferably between 0.1% and 0.15% of sulphur to lead by weight.

In one specific embodiment of the invention bullion containing for example about 0.03% to 0.06% copper is fed continuously at a controlled temperature and rate into a stirred chamber into which sulphur is also fed continuously at a controlled rate. This rate of sulphur addition is directly dependent on the bullion flow rate. Stirring in this chamber is such as maintain a pronounced vortex so that the sulphur is immediately carried beneath the surface of the bullion to minimise losses by burning in air. Some of the sulphur combines with some of the copper and a small amount of the lead, by the reactions referred to above, to form dross.

The bullion, dross and unreacted sulphur flow concurrently without back-mixing by means of gravity to another stirred chamber where mixing keeps all materials in close contact with each other. Further reaction takes place, lowering the copper content of the bullion and causing changes in both composition and quantity of dross formed.

This step is repeated sequentially in further stirred reaction chambers until a minimum copper content in the bullion of, for example, less than 0.005%, preferably less than 0.002%, is reached in the stream leaving the last stirred chamber. It has been found that there is an optimum average total residence time in the stirred chambers considered as a whole and the stirred chambers are designed to result in that average total residence time for the particular bullion flow rate required.

Bullion and dross (substantially all sulphur should be used by this stage) then flow into an unstirred settling chamber where the dross separate from the bullion by rising to the surface due to the lower specific gravity of that dross. The decoppered bullion flows out from the bottom of this chamber via an underflow weir and the dross is scraped from the surface by mechanical means.

It is preferable that the bullion remain in the settling chamber only long enough for the substantially complete separation of the dross from the bullion since resolution of copper into the bullion occurs if the bullion is left in contact with dross beyond this stage.

Bullion is preferably fed into the reaction chamber at a rate that is maintained constant or within a very small range for a constant number of reaction chambers of a certain capacity. This is necessary to maintain a constant or nearly constant average total residence time of bullion in the total reaction volume. The feed rate controlling device should preferably be such that it splits the feed bullion stream into a controlled stream and a variable excess stream. The latter can then be used for dross collection later in the process. A device that employs a constant head of bullion and a needle valve to vary the size of the discharge orifice is found to achieve this result. The excess bullion stream is then the overflow from the constant head reservoir.

The temperature of the input bullion is controlled to be as close as possible to the freezing point consistent with good handling conditions.

In the operation of a pilot plant in which this invention was used, the input bullion temperature was controlled at 340° C but a temperature of 315° C to 325° C is preferably. The rate controlling device was based on a needle valve principle giving a controlled bullion stream flow rate of 250 to 550 kg/hr.

The sulphur addition is preferably made at a closely controlled rate which is calculated directly as a percentage of the bullion flow rate, e.g. 0.05% to 0.25% by weight. The sulphur feeder is capable of reaching stirred reaction chambers other than the first so that at very low bullion flow rates, one or more chambers may be effectively removed from the reaction volume thus maintaining the constant or nearly constant average total residence time over the whole reaction volume. The feeder discharges directly into the vortex created by the stirrer so that the sulphur is immediately carried below the surface of the bullion.

Any form of feeder capable of delivering the calculated constant rate of sulphur can be used. The sulphur may be solid or molten but is preferably solid. If fed as a solid, the sulphur is screened to remove excessively large lumps that cannot be handled by the feeder.

In the operation of the pilot plant, an addition rate of sulphur of 0.05% to 0.25% of the bullion feed rate was maintained by a vibrating feeder discharging onto a water cooled chute and thence into the first reaction chamber. The sulphur was screened to about 3mm but on a commercial scale a larger size could readily be handled.

The reaction volume consists of more than one stirred reaction chamber connected in such a way that bullion, unreacted sulphur and dross flow concurrently from each to the next in sequence without back-mixing. Preferably each chamber is slightly below the level of the preceding one so that materials may cascade from one to the next under the influence of gravity.

The number and volume of these reaction chambers is preferably such that, for a given flow rate of bullion, the average total residence time in the reaction volume is between 5 and 25 minutes, preferably about 8 to 15 minutes. For different flow rates either the capacity of each chamber or the number of chambers may be varied. From an economic point of view, it is preferable to change the number of chambers in use rather than replace all chambers with ones of different size. A change in the number of chambers in use is most easily effected by leaving the bullion stream unaltered but changing the point of entry of the sulphur addition from one chamber to another.

The stirrers in the chambers may have one or more "tiers" of blades of length and pitch designed to create a pronounced vortex in the particular size and shape chamber in which they will operate. Each stirrer is preferably adjustable in vertical depth to maintain the vortex under different dross texture and flow rate conditions. Any motor of suitable power and speed may be used to drive the stirrers but the facility of variable speed to maintain vortex formation is an advantage.

A "shroud" may be used around the blades to the stirrer. This may be an open ended cylinder which directs material down through the top and out at the bottom. This enhances the circulation in a vertical plane, which promotes the formation of a pronounced vortex. Whether or not a shroud is necessary is determined mainly by the size and shape of the stirred chamber, the design of the stirrer blades, and the speed of rotation of the stirrer.

The overflow from the last reaction chamber consisting of bullion and dross discharges directly into an unstirred dross separation chamber in which the dross separates from the bullion by floating to the surface. Any turbulence caused by the entry of bullion and dross should be minimised so as to remove the dross from in contact with the bullion as quickly as possible to prevent resolution of copper into the bullion.

The volume of the dross separation chamber is preferably approximately the same as that of each reaction chamber. The shape of the dross separation chamber is such that suitable mechanical means can be used to remove the dross from the surface. The chamber is fitted with a syphon pipe or underflow weir so that the decoppered bullion may be withdrawn from below the dross that has floated to the surface.

The use of an unstirred dross separation chamber allows the dross to be removed from the surface continuously or intermittently by mechanical means. This means may be a reciprocating device travelling back and forth across the surface or a device revolving in a vertical plane such as a paddle wheel or any other suitable means that scrapes the dross across the surface and pushes it over a lip. Preferably, the excess stream of bullion from the inlet flow controller is made to run in an open external launder or channel beside and just below this lip, so that the dross falls directly into a stream of lead that flows fast enough to pick up this dross and carry it away. This stream of bullion may then be returned to the treatment step in which the bulk of the copper is removed from the bullion circuit.

Any form of heating such as gas or oil burners or electric resistance windings may be used. It is preferable that each chamber be heated separately for better control even if all chambers are contained in the one large insulated setting. Automatic control of the temperature in each chamber is preferred as the temperature is preferably maintained as close as to the freezing point of the bullion as possible while still allowing it to flow freely from one chamber to the next.

Reference will now be made to the embodiments of the invention shown in the accompanying drawings. It is to be understood that we are not to be regarded as limited to or by the form of the embodiments illustrated in the drawings or to or by the ensuing description thereof.

Figure 2:
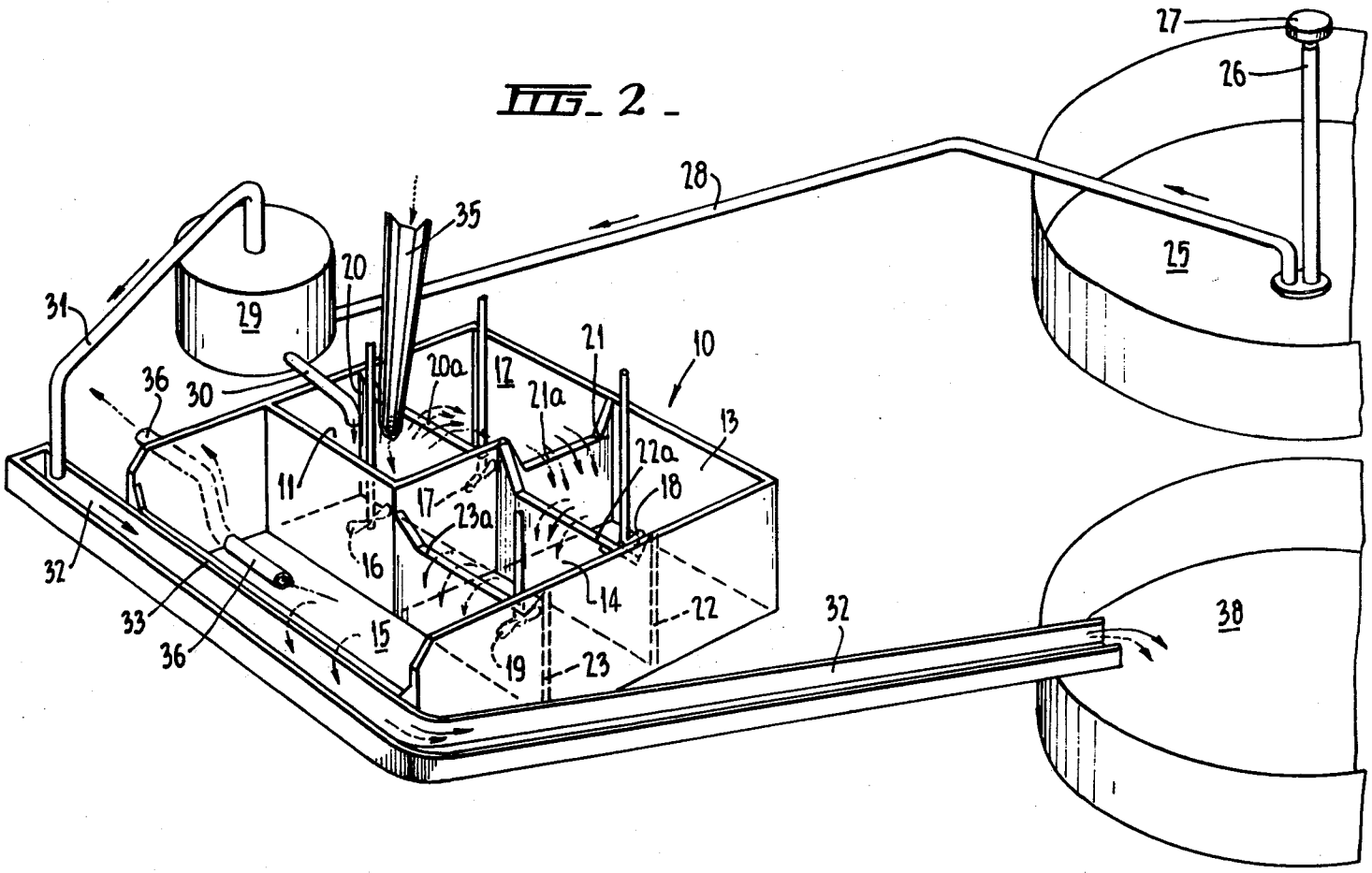
Figure 4:
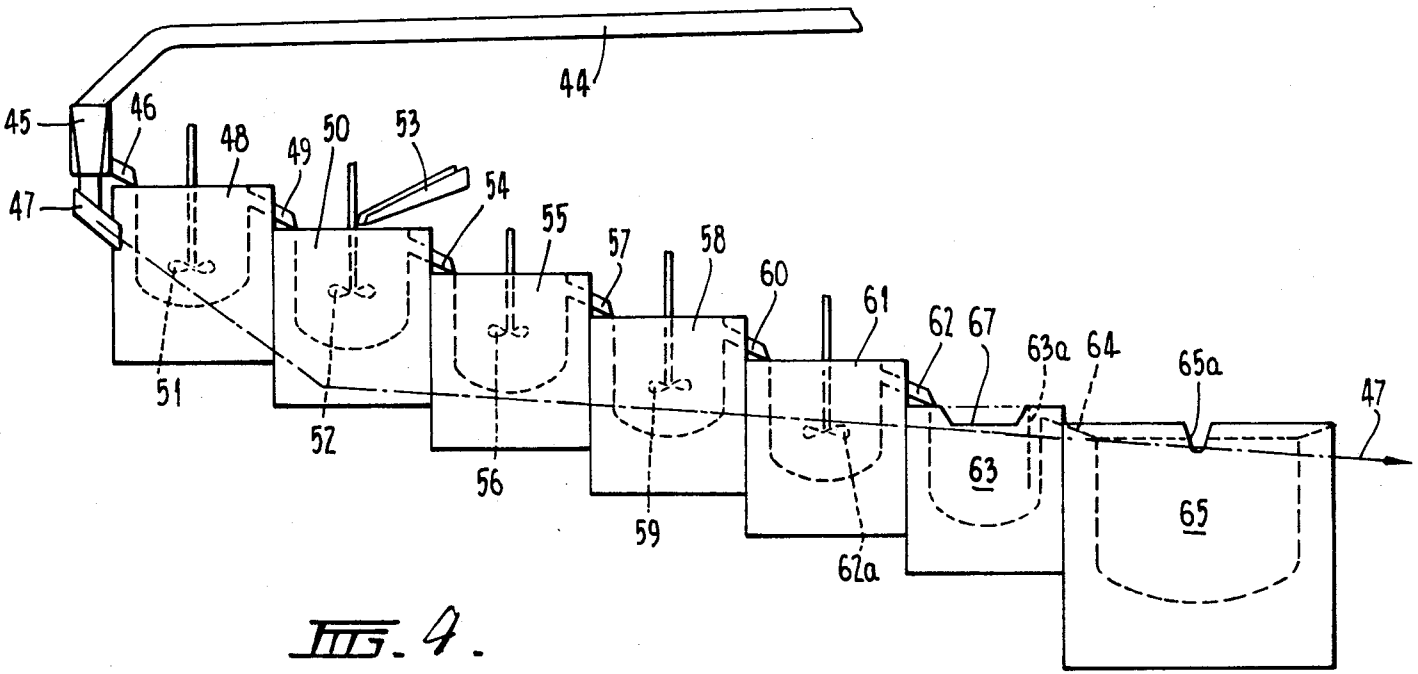
Figure 5:
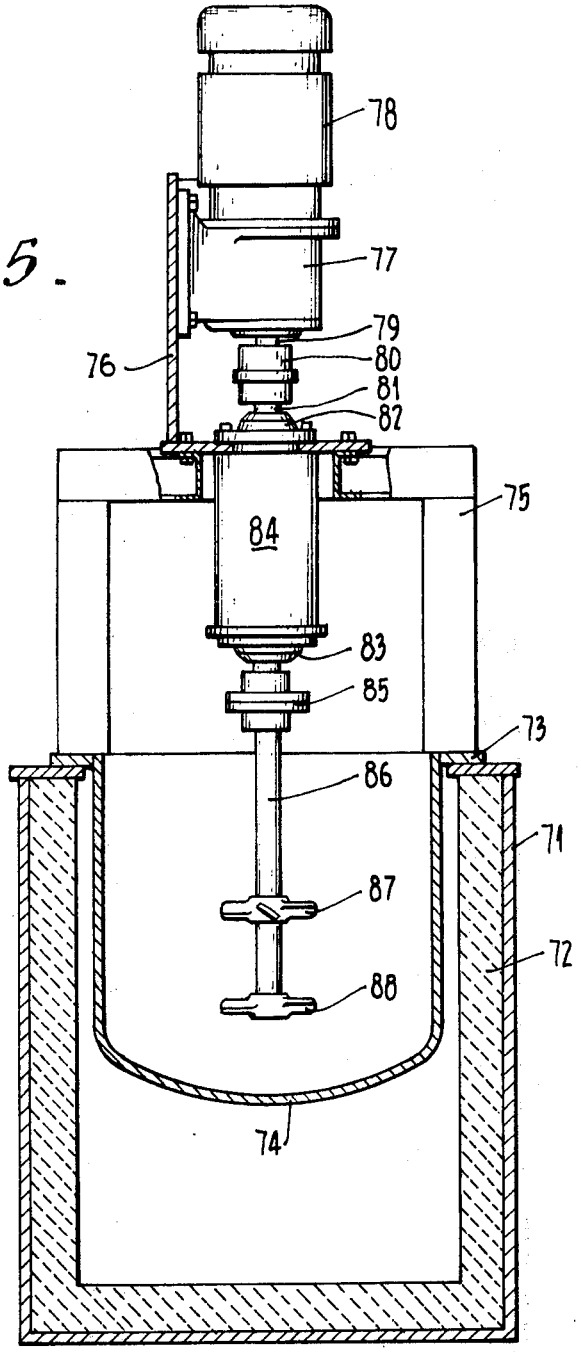
Figure 6:
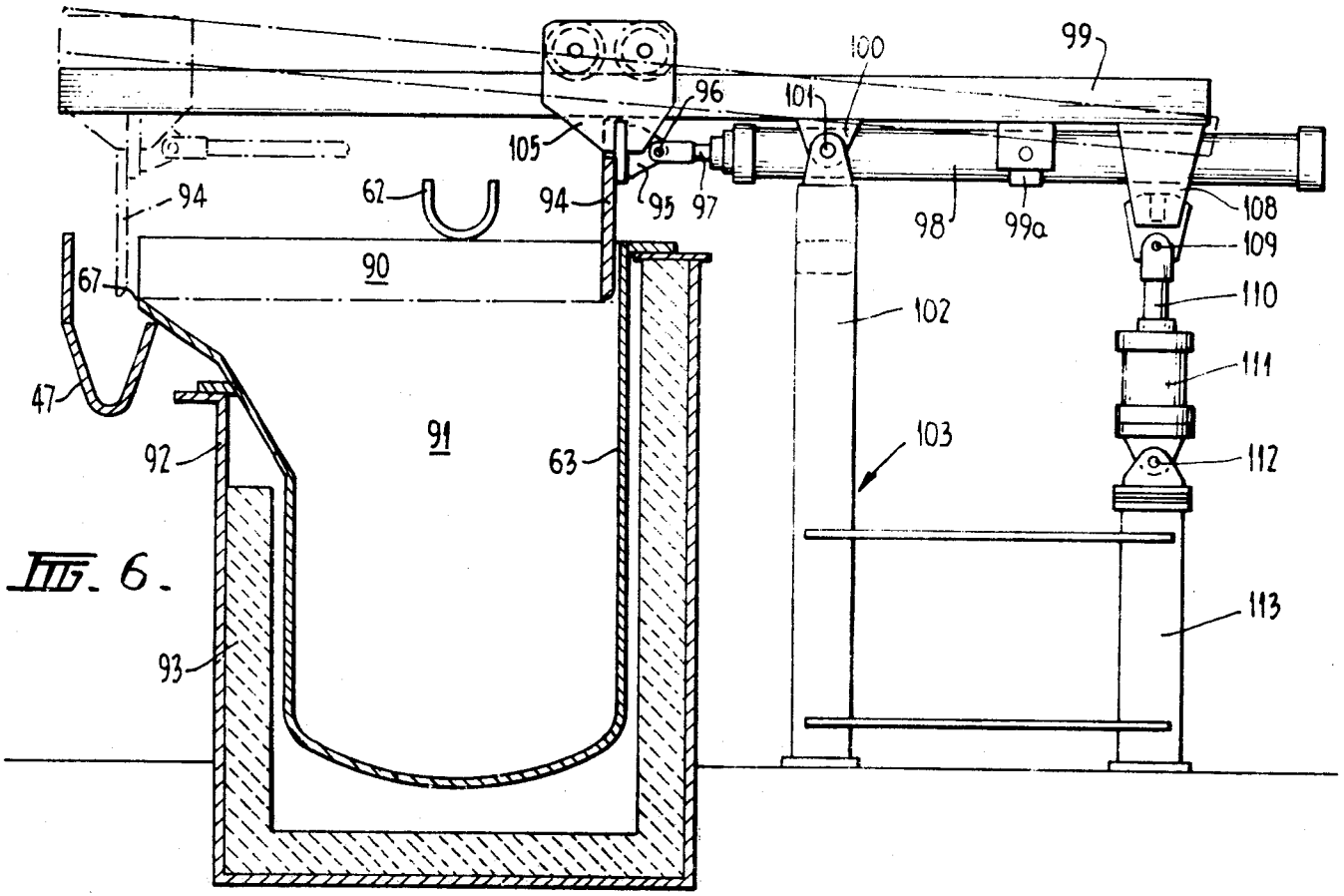

In these drawings:

FIG. 1 is a graph showing the result of measurements of copper concentration of lead against time as referred to on page 3 of this specification, FIG. 2 is a schematic perspective view of pilot plant apparatus for carrying out the process of this invention which has been used at the Port Pirie Works of The Broken Hill Associated Smelters Proprietary Limited, FIG. 3 is a schematic plan view of a modified form of apparatus for carrying out the invention, FIG. 4 is a schematic view in elevation taken on the line 4—4 of FIG. 3, FIG. 5 is a view in sectional elevation of one of the reaction pots shown in FIGS. 3 and 4, showing the stirrer and the stirrer drive means, and FIG. 6 is a view in sectional elevation of a mechanism for scraping the dross from the surface of the bullion in the dross separation pot into the adjacent launder.

In FIG. 2 of the drawings the flow of bullion to be decoppered is shown in full lines, the flow of sulphur is shown by dotted lines, the flow of dross is shown by chain-dotted lines, and the flow of treated bullion is shown by dot-and-dash lines.

Referring to the apparatus as shown in FIG. 2, the reference numeral 10 indicates generally the pilot plant apparatus of the invention which comprises a series of chambers arranged for convenience roughly in the form of a square, these being a first stirred reaction chamber 11, a second stirred chamber 12, a third stirred reaction chamber 13, a fourth stirred reaction chamber 14, and a fifth unstirred dross separation chamber 15. Stirrers 16, 17, 18, 19 are mounted in the chambers 11, 12, 13, 14 respectively and their vertical shafts are driven by electric motors or other power means (not shown). The vertical walls 20, 21, 22, 23 between chambers 11, 12, between chambers 12,13 between chambers 13,14 and between chambers 14,15 respectively, are constructed so that their upper edges form overflow lips or weirs 20*a*, 21*a*, 22*a* and 23*a* of decreasing heights, so that bullion, dross and any unreacted sulphur from each of the vessels 11, 12, 13, 14 will overflow into the next in the series, as shown by the arrows in FIG. 2.

The weirs 20*a*, 21*a*, 23*a* and particularly the weir 20*a* are preferably so constructed, e.g., by the provision of a notch or restricted overflow section, that the depth of the stream overflowing the weir is sufficient to ensure that the dross is carried over into the next vessel.

The reference numeral 25 indicates a pan or vessel containing lead bullion to be decoppered, the temperature of which is controlled at about 340° C to 350° C. A pump 26 driven by motor 27 pumps molten bullion from the pan 25 through the pipe 28 to a rate controlling device 29. An advantage of this arrangement is that the temperature of the bullion in the pan 25 can be so adjusted that by the time the bullion is entering the first stirred reaction chamber 11, it is close to the freezing point, which is desired.

The rate controlling device 29 operates on a needle valve and constant head principle and splits the pumped stream of bullion into a controlled stream through pipe 30 into the chamber 11 and an excess stream which flows through pipe 31 into the launder 32 which is adjacent to the series of chambers. The stream of bullion flows around the launder 32 to collect the dross scraped from the surface of the dross separation chamber 15 which flows over the wall 33 of the chamber 15.

Sulphur is fed at a controlled rate into the first stirred chamber 11 via the water cooled chute 35. After reaction with the bullion in reaction chamber 11, dross and remaining sulphur are carried over the flat weir 20*a* by the bullion into the next stirred reaction chamber 12 where further reaction occurs. This process is repeated in reaction chambers 12, 13 and 14 and the bullion, dross and any unreacted sulphur flow from each chamber to the next over weirs 21*a*,22*a* until the bullion and dross flows from chamber 14 over weir 23*a* into the dross separation chamber 15. The dross floats to the surface in the chamber 15 and the decoppered bullion flows out from beneath the dross via the syphon pipe 36 to moulding facilities or a holding vessel.

As mentioned above, the dross is manually or mechanically scraped off the lead surface in the chamber 15 and over the weir 33 into the excess stream of bullion flowing in the launder 32. This stream of bullion and collected dross indicated by the arrows then flows to another vessel 38 to which completely untreated bullion is being added ready for hot drossing. This arrangement has the advantage of using the cool dross-carrying stream of bullion to effect part of the temperature drop of the untreated bullion required in hot drossing. This system of feeding bullion and removing dross can only be made completely continuous if more than two vessels are available for hot drossing. Consequently in this respect the arrangement shown in FIGS. 3 to 6 is preferable.

Referring to the apparatus shown in FIGS. 3 to 6, the reference numeral 40 indicates the "circulating pump pot" of a continuous drossing furnace (CDF) of the type described in U.S. Pat. No. 3368805. This pot 40 is connected to the body of the CDF by an underflow weir. The bullion from pot 40 is allowed to flow around a launder 41 in which water cooled plates are suspended, before returning to the furnace through the "cooled lead pot" 42. This cooled bullion mixes with the fresh hot bullion within the body of the CDF. Thus the "drosses" rising to the surface are melted by the oil burners are removed from the CDF by tapping a liquid "matte" of lead and copper sulphides. The cold partially decoppered lead at the bottom of the CDF discharges through an underflow weir into the "delivery pump pot" 43.

The delivery pump pot 43 of the CDF provides an ideal supply point from which bullion can be pumped directly to the sulphur drossing equipment of this invention. Since matte is the saleable copper product and it is the CDF from which the copper as matte leaves the bullion circuit in the plant, it is logical to return the dross from sulphur drossing to the CDF. This can most easily be done by collecting the dross with a stream of bullion and returning it to the cooled lead pot 42 of the CDF.

Partially decoppered bullion is pumped out of the delivery pump pot 43 of the CDF to flow along the launder 44 until it reaches the rate controlling device 45. This device, operating on a constant head and variable discharge orifice principle, splits the stream of bullion into a controlled rate stream which flows through pipe 46 and a variable excess stream which overflows into the launder 47.

The controlled bullion stream discharges through pipe 46 into the stirred temperature regulation vessel or pot 48. In this pot, the temperature will be lowered to close to the freezing point by automatically controlled water sprays on the surface (not shown) or other suitable means. The cooled bullion then overflows via a short "U" shaped channel 49 into the first stirred reaction pot 50. The stirrers in vessels 48 and 50 are indicated by the numerals 51 and 52.

Sulphur is fed at a controlled rate down the water cooled chute 53 into the vortex formed by the stirrer 52 in this pot 50. Reactions will take place between the sulphur and both lead and copper to form the sulphide mixture, dross. This dross, unreacted sulphur and partly decoppered bullion overflow via channel 54 into the next stirred reaction pot 55 having a stirrer 56. Here, further reaction will take place using up sulphur, changing both the quantity and composition of the dross, and lowering the copper content of the bullion. Dross, bullion and any unreacted sulphur then overflow via channel 57 into stirred reaction pot 58 and so on via channel 60 through stirred reaction pot 61 until the dross and decoppered bullion overflow via channel 62 into the unstirred dross separation pot 63. Stirrers 51,52,56,59 and 62*a* are provided in the pots 48,50,55,58 and 61 respectively.

In this pot 63, the dross rises to the surface leaving the decoppered bullion below. The bullion flows out via an underflow weir 63*a* and an overflow channel 64 into a holding vessel 65 in which it can be reheated slightly before pumping away via pipe 66 to further stages of treatment.

The dross is scraped mechanically as by the mechanism shown in FIG. 6 from the surface of the separation pot 63 over the lip 67 into the launder 47 in which the excess stream of bullion is flowing. This stream will collect the dross and carry it back to the cooled lead pot 42 of the CDF. This requires a minimum of manual labour and conveniently returns the copper to the process by which it is removed from the bullion circuit.

The overflow channel 65*a* of pot 65 is provided so that, if required, the product bullion can be diverted back to the CDF via launder 47 by switching off the pump in pot 65.

A variation of the above procedure may be used for treating low flow rates of bullion. At low flow rates, the required average total residence time of bullion in the reaction pots may be reached in only three pots of the four. For example, if at normal flow rates, there is an average residence time of 2.25 minutes in each reaction pot, the average total residence time in all four reaction pots is 9 minutes. At low flow rates, the average residence time in each reaction pot may be 3 minutes. Therefore only three reaction pots are needed to give an average total residence time of 9 minutes. Thus the sulphur chute 53 is arranged to feed sulphur into the vortex of the stirrer 56 in the second stirred reaction pot 55. In this case reaction will take place in only three of the stirred reaction pots, namely the pots 55, 58 and 61. The first stirred reaction pot 52 then effectively becomes part of the bullion feeding system. All other parts of the system remain unchanged.

In the arrangement shown in FIGS. 3 to 6 of the drawings each of the pots 48, 50, 55, 58, 61, 63 and 65 is shown at a lower level than that of the pot immediately preceding it in the series, so that the materials may conveniently flow by gravity from each pot to the next, and this system is preferred, but it will be understood that the pots may be at any desired levels and that the materials may be pumped from one pot to the next, if desired. It will also be understood that other means for transferring materials from one pot to another may be employed if considered desirable.

The average residence time in each pot or vessel may be the same or different, and the average total residence time in all the reaction vessels is preferably between 5 and 25 minutes, more preferably between 8 and 15 minutes.

Referring to FIG. 5 of the drawings, the reference numeral 70 indicates any one of the stirred reaction pots 48, 50, 55, 58 or 61, and is provided with an outer metal casing 71 and a refractory lining 72 within the casing 71. The pot 70 is provided with an upper peripheral flange 73 which rests on the upper end of the casing 71. The lower end 74 of the pot 70 is curved downwardly. A frame 75 is erected above the pot 70 and is provided with an upwardly extending bracket 76 which supports the casing 77 on which is supported an electrical motor 78. The shaft 79 of the motor 78 is connected to a motor coupling 80 which in turn drives a shaft 81 which is carried in bearings 82 and 83 mounted at the upper and lower ends of a support casing 84. A further coupling 85 is provided through which the shaft 81 drives a spindle 86 on which are mounted stirrer blades 87, 88. By means of the stirrers 87,88 adequate and substantially complete stirring of the contents of the reaction pot 70 is effected.

Referring to FIG. 6, the mechanism illustrated in this FIG. is one form of apparatus which may be used for scraping the dross shown diagrammatically at 90 from the surface of the bullion 91 in the dross separation pot 63, over the lip 67 of the pot 63 into the launder 47. The channel 62 leading from the reaction pot 61 is shown in end elevation in this Figure.

The pot 63 is supported on a casing 92 within which is mounted refractory lining 93. The scraping blade 94 is secured to a bracket 95 which is pivotted at 96 to a piston 97 of a pneumatic cylinder 98 which is supported on a substantially horizontal tiltable beam 99, by a bracket 99*a,* the beam 99 is provided with a bracket 100 which is pivotted at 101 to an upright 102 of a frame 103 on which the mechanism is supported.

The scraping blade 94 is supported on a frame 105 which travels longitudinally on the beam 99 by rollers 106.

The end of the beam 99 remote from the scraping blade 94 is provided with a bracket 108 which is pivotted at 109 to the piston 110 of a pneumatic cylinder 111 which is pivotted at 112 to the upper end of upright 113 of the frame 103.

In operation, the cylinder 111 and piston 110 are activated to move the beam 99 to its horizontal position as shown in full lines in FIG. 6 and the cylinder 98 is then operated to move the piston 97 and scraping blade 94 from the position shown in full lines to the position shown in dotted lines in FIG. 6. This movement of the scraping blade 94 moves the dross 90 from the surface of the bullion 91 in the reaction pot 63 over the lip 67 into the launder 47 where it is carried away by the bullion stream (not shown) therein. The cylinder 111 is then operated to lower the piston 110 and thus to tilt the beam 99 to the position shown in dotted lines in FIG. 6, thereby raising the scraping blade 94 out of contact with the dross 90 and bullion 91 and the scraping blade 94 is then retracted by the piston 97 and cylinder 98 to its initial position as shown in full lines in FIG. 6 so that the scraping cycle may be recommenced.

By this means continuous or intermittent scraping of the dross 90 from the reaction pot 63 into the launder 47 may be effected.

EXAMPLE 1

Continuous sulphur drossing of lead bullion was carried out at the Port Pirie Works of The Broken Hill Associated Smelters Proprietary Limited in a pilot plant constructed substantially as shown in FIG. 2.

Typical compositions of the bullion before and after treatment in the said pilot plant were as follows:-

| | COMPOSITION OF BULLION | |
|---|---|---|
| Element | Before Treatment | After Treatment |
| Cu | 0.06% | 0.002% |
| As | 0.2 | 0.2 |
| Sb | 0.5 | 0.5 |
| Bi | 0.005 | 0.005 |
| Ag | 0.1 | 0.1 |
| S | 0.0025 | 0.0005 |

The figures shown in Table 1 are indicative of the results consistently achieved in the pilot plant. The copper content of the bullion leaving the dross separation chamber 15 at 314° C was typically 0.002%. In other tests under similar conditions copper contents as low as 0.0009% were achieved.

TABLE 1

| Run No. | Feed Bullion Assay (% Cu) | Sulphur Addition Rate (% of Bullion) | Bullion Flow Rate (kg/hr) | Average Residence Time per Stage (Mins.) | Input Temp. °C | Exit Temp. °C | Copper Concentration reached in the following compartments indicated in Figure 2 | | | |
|---|---|---|---|---|---|---|---|---|---|---|
| | | | | | | | 11 | 12 | 13 | 14 |
| 1 | .023 | .14 | 252 | 4.4 | 318 | 318 | .005 | .003 | .002 | .003 |
| 2 | .026 | .14 | 450 | 2.5 | 322 | 314 | .013 | .004 | .003 | .002 |
| 3 | .027 | .11 | 440 | 2.5 | 330 | 314 | .009 | .004 | .003 | .002 |
| 4 | .026 | .09 | 370 | 3.0 | 330 | 319 | .010 | .005 | .003 | .002 |
| 5 | .026 | .09 | 480 | 2.3 | 330 | 319 | .008 | .003 | .002 | .0015 |
| 6 | .025 | .07 | 525 | 2.1 | 325 | 317 | .015 | .010 | .003 | .003 |
| 7 | .025 | .07 | 586 | 1.9 | 325 | 315 | .009 | .0082 | .003 | .0017 |
| 8 | .025 | .05 | 560 | 2.0 | 325 | 318 | .015 | .010 | .007 | .006 |

We claim:

1. A continuous sulphur drossing process for the decoppering of lead which comprises:
   - continuously flowing lead bullion into the first of a series of at least two reaction vessels;
   - continuously agitating the lead bullion in the first reaction vessel;
   - continuously adding sulphur to the lead bullion in the first reaction vessel during the continuing agitation;
   - continuously and concurrently transferring the lead bullion, dross arising from copper reacted with the sulphur, and any unreacted sulphur from each reaction vessel to the next in the series, without back-mixing;
   - continuously agitating the contents of each reaction vessel;
   - maintaining the average total residence time of the materials in the reaction vessels below that within which a significant amount of reversion to elemental copper would occur, thereby substantially preventing re-solution of copper in the bullion;
   - continuously and concurrently transferring decoppered bullion and dross from the final reaction vessel in the series to an unagitated dross separation vessel;
   - removing the dross from the surface of the decoppered bullion in the dross separation vessel; and
   - continuously withdrawing decoppered bullion from the dross separation vessel.

2. A process according to claim 1, wherein the step of flowing includes the steps of feeding the lead bullion into an introductory vessel, agitating the lead bullion in the introductory vessel, and transmitting the lead bullion into the first reaction vessel.

3. A process according to claim 2 including the step of converting the introductory vessel into a reaction vessel wherein the sulphur is added into the introductory vessel during agitation of the lead bullion and the step of transmitting includes the lead bullion dross arising from copper reacted with the sulphur in the introductory vessel, and any unreacted sulphur.

4. A process according to claim 1 wherein the copper content of the bullion at introduction into the process is not greater than 0.06%.

5. A process according to claim 1 wherein the continuous sulphur drossing treatment is carried out in at least three reaction vessels.

6. A process according to claim 1 wherein the continuous sulphur drossing treatment is carried out in at least four reaction vessels.

7. A process according to claim 1 wherein the temperature of the bullion to which the sulphur is added is controlled to between the freezing point of the bullion and 350° C.

8. A process according to claim 7 wherein the temperature of the bullion to which the sulphur is added is controlled to between 315° C and 325° C.

9. A process according to claim 1 wherein the rate of addition of sulphur to the lead bullion is regulated to between 0.05% and 0.25% of sulphur to lead by weight.

10. A process according to claim 9 wherein the rate of addition of sulphur to the bullion is regulated to between 0.1% and 0.15% of sulphur to lead by weight.

11. A process according to claim 1 wherein the average total residence time of the bullion, dross and sulphur in all vessels of the series containing added sulphur (excluding the dross separation vessel) is between 5 and 25 minutes.

12. A process according to claim 11 wherein the average total residence time of the bullion, dross and sulphur in all vessels in the series containing added sulphur (excluding the dross separation vessel) is between 8 and 15 minutes.

13. A process according to claim 1 wherein the average total residence time of the bullion, dross and sulphur in all vessels in the series containing added sulphur (excluding the dross separation vessel) is not greater than that required for the copper content of the bullion to reach its minimum value.

14. A process according to claim 1 wherein the average residence time of the bullion, dross and sulphur in each vessel of the series to which the sulphur is added (excluding the dross separation vessel) does not exceed 6 minutes.

15. A process according to claim 1 wherein the step of agitating in the vessel to which the sulphur is added includes creating a vortex by stirring, and wherein the sulphur is fed into the vortex.

16. A process according to claim 1 including the step of creating a vortex in each reaction vessel, except the dross separation vessel, by stirring, and wherein the materials from each vessel are fed into the vortex formed in the next reaction vessel in the series.

17. A process according to claim 1 wherein the copper content of the decoppered bullion is less than .002%.

* * * * *